US007210949B2

(12) United States Patent
Duncan et al.

(10) Patent No.: US 7,210,949 B2
(45) Date of Patent: May 1, 2007

(54) ELECTRICAL APPLIANCES

(75) Inventors: Christopher Robert Duncan, Somerset (GB); Michael Edward Gailes, Dorset (GB)

(73) Assignee: Numatic International Limited (GB)

( * ) Notice: Subject to any disclaimer, the term of this patent is extended or adjusted under 35 U.S.C. 154(b) by 0 days.

(21) Appl. No.: 10/508,577

(22) PCT Filed: Apr. 29, 2003

(86) PCT No.: PCT/GB03/01826

§ 371 (c)(1),
(2), (4) Date: Aug. 10, 2005

(87) PCT Pub. No.: WO03/094309

PCT Pub. Date: Nov. 13, 2003

(65) Prior Publication Data

US 2006/0003636 A1 Jan. 5, 2006

(30) Foreign Application Priority Data

Apr. 29, 2002 (GB) ..... 0209785.5

(51) Int. Cl.
*H01R 3/08* (2006.01)

(52) U.S. Cl. ..... 439/176; 439/189; 439/694

(58) Field of Classification Search ..... 439/176, 439/694, 189, 684

See application file for complete search history.

(56) References Cited

U.S. PATENT DOCUMENTS

| | | | | |
|---|---|---|---|---|
| 2,716,737 | A * | 8/1955 | Maberry | 439/176 |
| 3,025,490 | A | 3/1962 | Hicks | |
| 6,146,166 | A * | 11/2000 | Muzslay | 439/176 |
| 6,471,365 | B2 * | 10/2002 | Wang et al. | 362/84 |
| 2005/0032405 | A1 * | 2/2005 | Wu | 439/176 |

FOREIGN PATENT DOCUMENTS

| | | | |
|---|---|---|---|
| DE | 1191481 | B | 4/1965 |

* cited by examiner

*Primary Examiner*—Gary F. Paumen
(74) *Attorney, Agent, or Firm*—Woodard, Emhardt, Moriarty, McNett & Henry LLP

(57) ABSTRACT

According to the present invention there is provided an electrical appliance having a releasable cable connector for electrically connecting the appliance to a remote power supply, wherein a first junction means is adapted to provide the releasable electrical connection between the cable connector and the appliance, characterised by the provision of a second junction means adapted to provide a non-releasable, hard-wired electrical connection between an alternative cable connector and the appliance, wherein the first junction means and the second junction means are arranged and configured so that the selection and use of one of said junctions by attachment of one cable connector precludes the simultaneous selection of the other connector.

15 Claims, 9 Drawing Sheets

FIG. 9
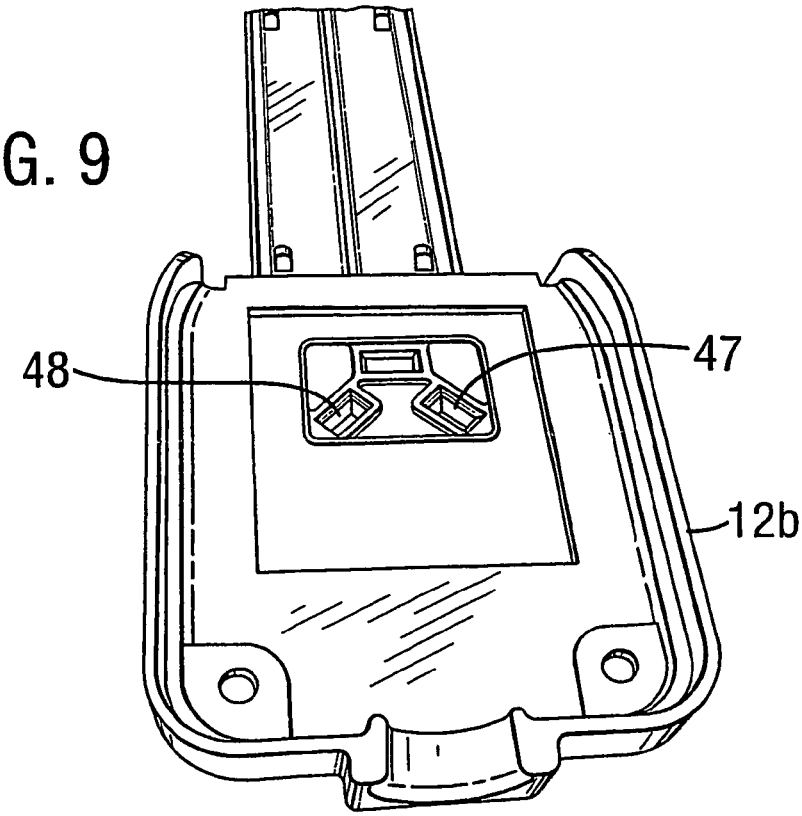
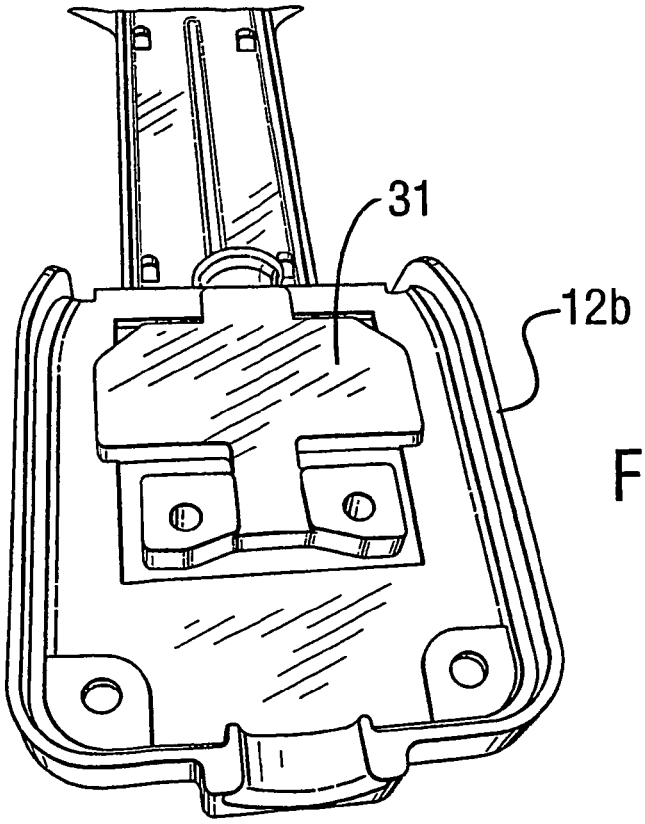
FIG. 10

ELECTRICAL APPLIANCES

This invention relates to electrical appliances and has particular reference to appliances such as vacuum cleaners, polishing machines and scrubber dryers. In the field of portable electrical appliances, the cable connecting the appliances to a power supply is generally hardwired to terminals within the appliance. Such arrangements are generally electrically safe, but with intense use it is not unusual for a power cable to become damaged and require replacement. To effect such a replacement, the appliance will need to be partially dissembled and a new cable hardwired to the terminals within the appliance. The appliance is then reassembled ready for use.

Industrialised countries are beginning to implement regulations where if removal and reconnection of wires is involved, such equipment can only be serviced by a qualified electrician. In such circumstances, where there is a failure of the power cable, some considerable delay may occur before a repair can be effected during which time, of course, the appliance is un-usable.

In recent years there has been a proposal to use a "plugged" power supply whereby the power cables for the appliance is detachable both from the mains supply socket and from the appliance itself. This has the advantage that in the event of the cable becoming damaged, it can be changed relatively easily simply by exchanging cables. In these circumstances, the cable can be exchanged without reliance on any technical skill or knowledge. However, it is sometimes the case that a cable will fail when no spare cable is available and once again, the appliance in question cannot be used until a new, compatible, plugged cable can be obtained.

In the manufacture of such appliances, it is also necessary for the manufacturer to make provision for both types of cable connection. This is time-consuming and expensive as the production line has to be altered for machines destined for different jurisdictions. Since there is a structural difference in the assembly of the components of the machine, this can involve additional manufacturing cost. There is a need, therefore, for a more versatile system, which permits the use of a plugged, or hard-wired cable to be used at the discretion of the user.

According to one aspect of the present invention, there is provided an electrical appliance having a releasable cable connector for electrically connecting the appliance to a remote power supply, wherein a first junction means is adapted to provide the releasable electrical connection between the cable connector and the appliance, characterised by the provision of a second junction means adapted to provide a non-releasable, hardwired electrical connection between an alternative cable connector and the appliance, wherein the first junction means and the second junction means are arranged and configured so that the selection and use of one of said junctions by attachment of one cable connector precludes the simultaneous selection of the other connector.

In one embodiment, the first junction means comprises a plug and socket combination. The socket may be provided on the releasable cable connector, and terminal pins mateable therewith are provided on the appliance.

The second junction means may comprise at least electrical two terminals, such as a screw terminal or a wire clamp, which provide means to attach bare connector cable wire cores to the junction.

Typically, the releasable or alternative cable connector is a two or three core mains cable.

The plug pins of the first junction may be removably mounted, and removal of the pins prevents use of the releasable connection. The plug pins should each be electrically connected to respective terminals of the appliance.

The plug pins may be rendered removable by screw-threaded attachment of the pins to appliance electrical terminals.

In a preferred arrangement, the same appliance terminals serve both the first junction means and the second junction means.

In another aspect of the invention the appliance is provided with a removable blanking member, which blanking member is mountable on the appliance in two positions; a first position in which the first junction means is obstructed so as to be un-usable for connection to a cable, and a second position in which the first junction means is freed from obstruction and the second junction means is obstructed. The blanking member is preferably a plate member.

The blanking member may be formed with one or more dummy plugs or pins which may be entered into a socket or pin-retaining recesses of the first junction means, there by to obstruct connection.

The blanking member is provided with a masking piece which, in the second position, occupies an opening in the appliance for the alternative cable connection means, thereby obstructing the second junction means against connection.

In the second position, the blanking member may overlay a retaining clamp for the alternative cable, whereby the alternative cable may not be clamped in place while the blanking member is in the second position.

In the first position of the blanking member, the blanking member overlays socket or pin location features, so that the first junction means may not be used to make a connection.

The present invention provides an arrangement in which allows the replacement of a primary releasable connection cable to an appliance by a non-specific cable which requires a hard-wired connection between free electrical cores thereof and the appliance. This is particularly useful in third world or countries in which spare parts are difficult to obtain, so that a filed primary releasable cable may not easily be replaced. Generally, hard-wireable cables are universally available and may therefore be used to replace the manufacturers supplied cable.

In the foregoing it is intended that the term "releasable" used with regard to cable connections, means releasable without having to interfere with electrical cable terminals. For example a plug and socket combination allows connection without access to the electrical terminals within the plug or socket. A non-releasable hard-wired connection is one in which in order to make the connection an electrical terminal (s) must be manipulated, typically by accessing the terminals and creating a direct connection between the terminals and the cores of a cable. Examples of such connections are screw threaded clamping terminals which receive exposed wire cores. A soldered connection is another option. Thus, the non-releasable connection may be disconnected by unscrewing of a terminal, or the application of heat to de-solder. This however is not a "releasable" connection in the meaning of this patent specification.

Figure 5:
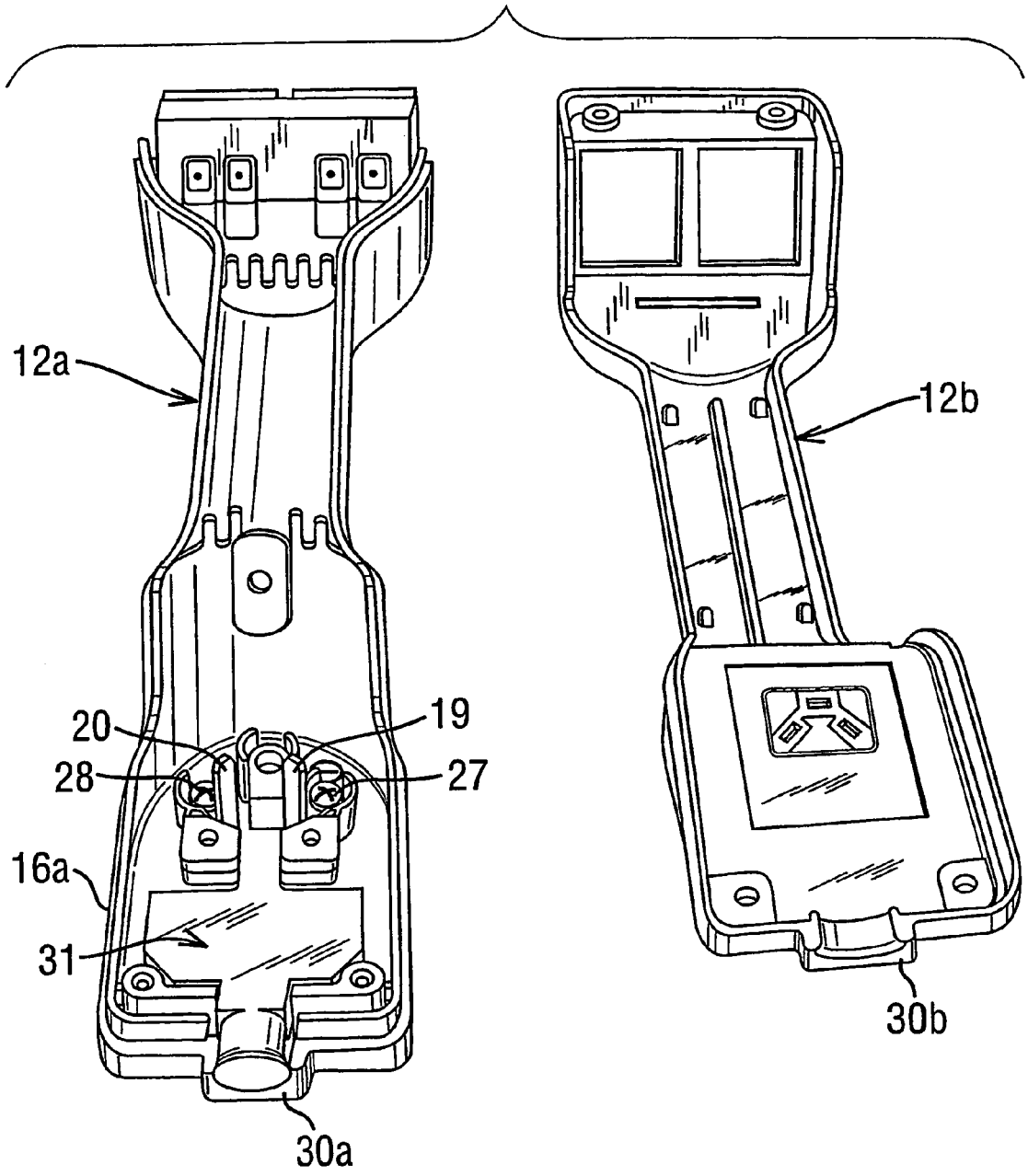
FIG. 5 is a disassembled view of the handle shown in FIG. 2.
Figure 5A:
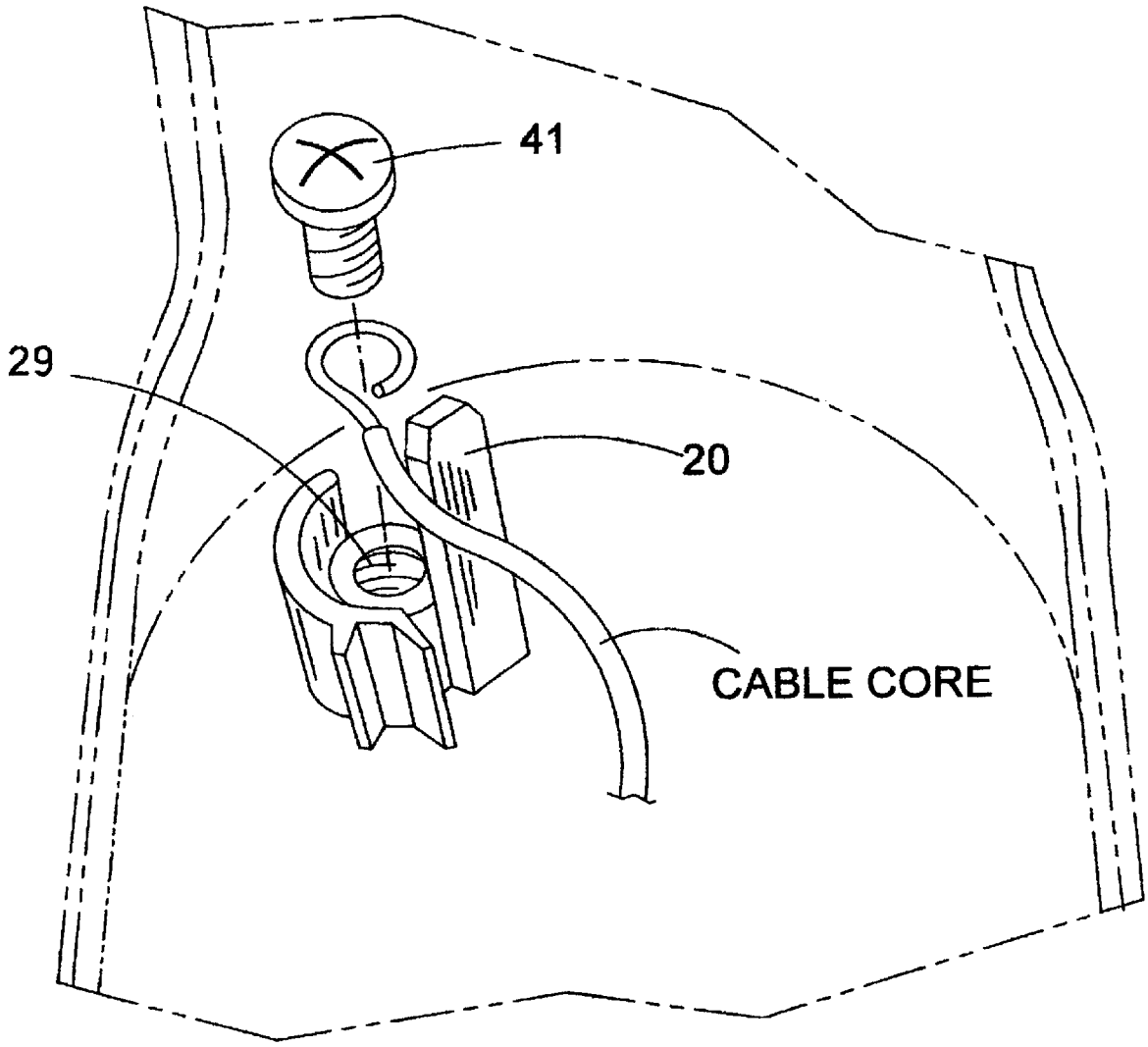

FIG. 5*a* is an enlarged, exploded view of the terminal pin 20, screw 41 and cable core combination of FIG. 5.

Figure 6:
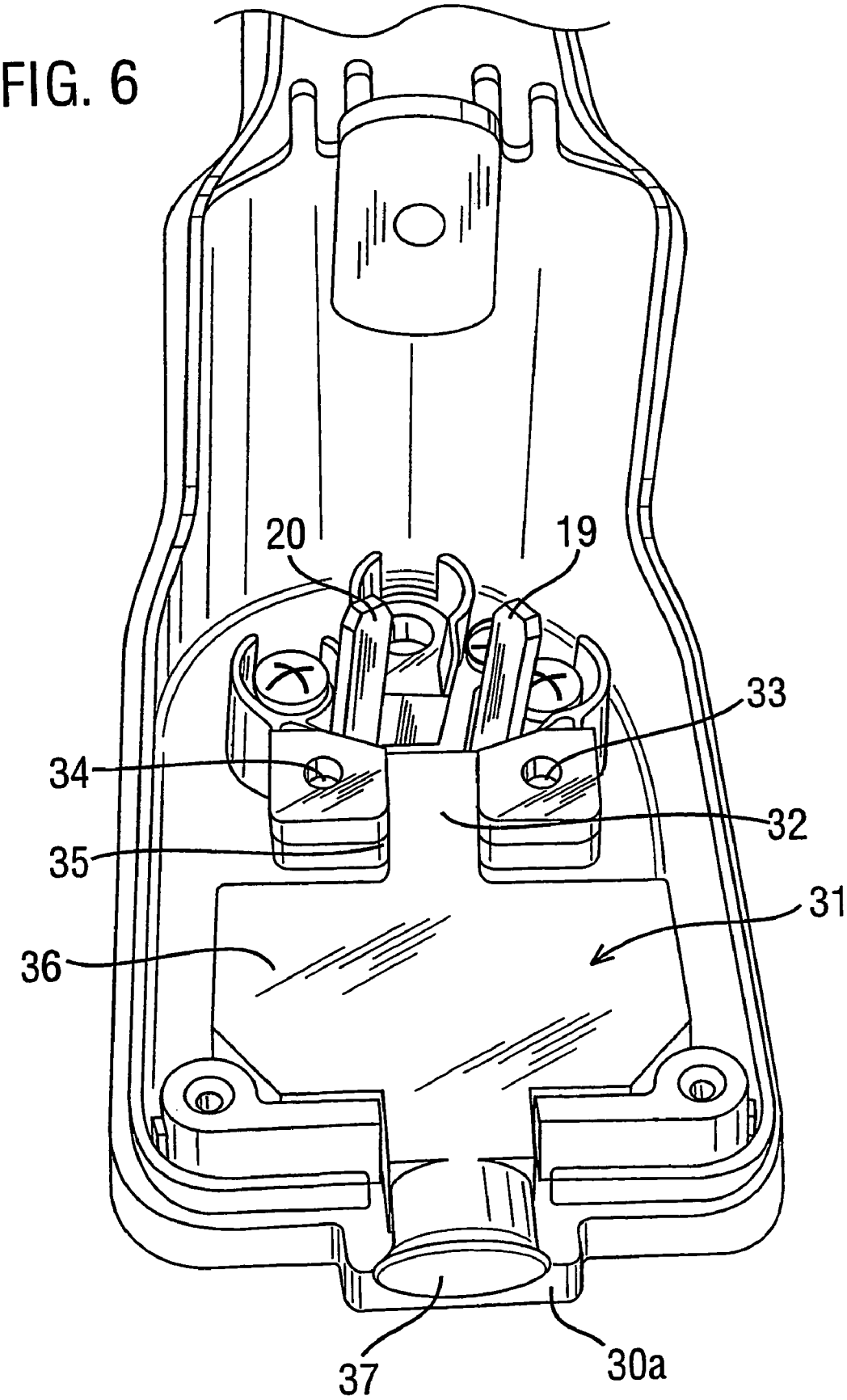

FIG. 6 is an enlarged view of an electrical connection the portion of the handle shown in FIG. 5.

Figure 7:
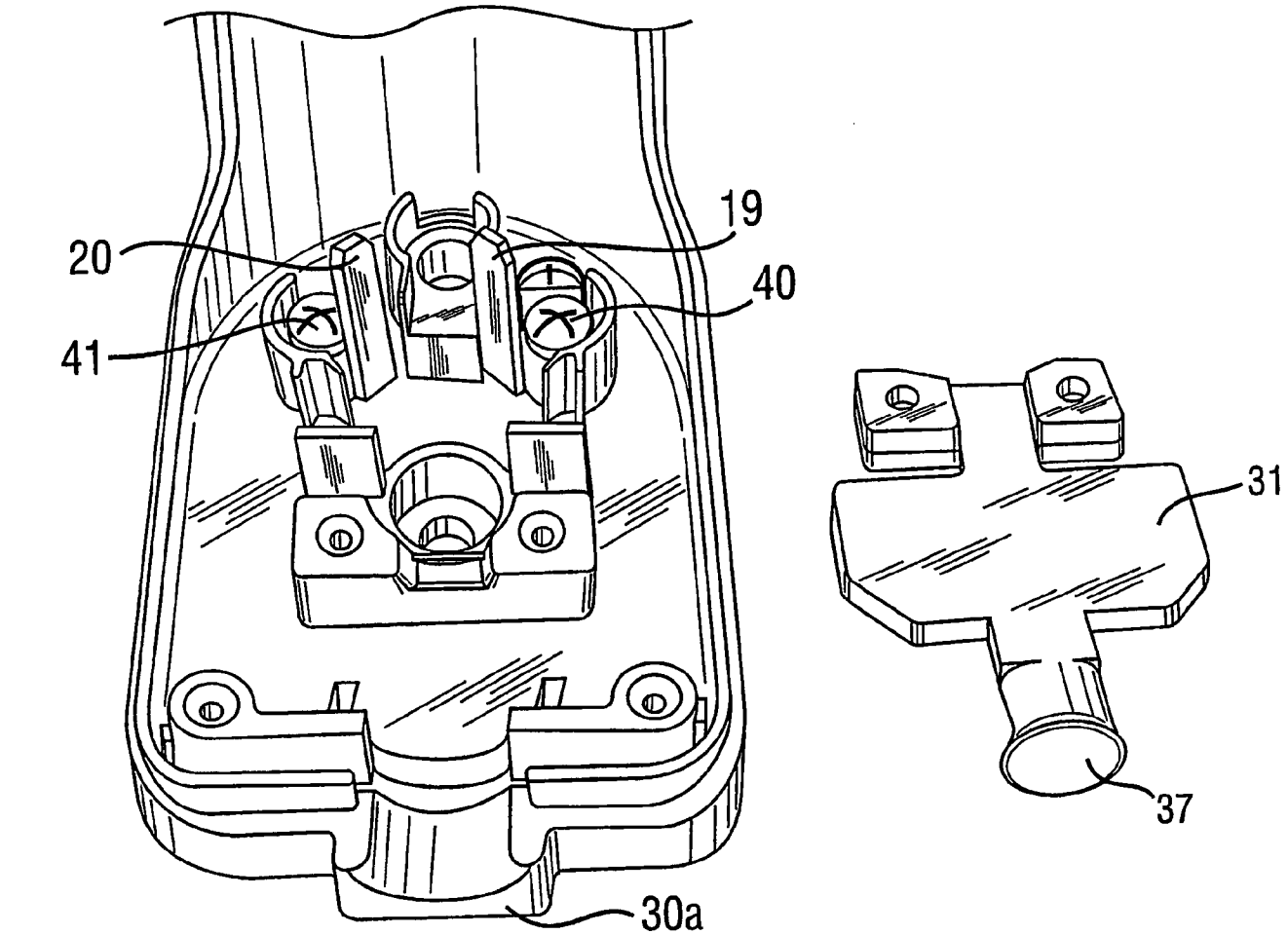

FIG. 7 shows the electrical connector in semi-disassembled state.

Figure 8:
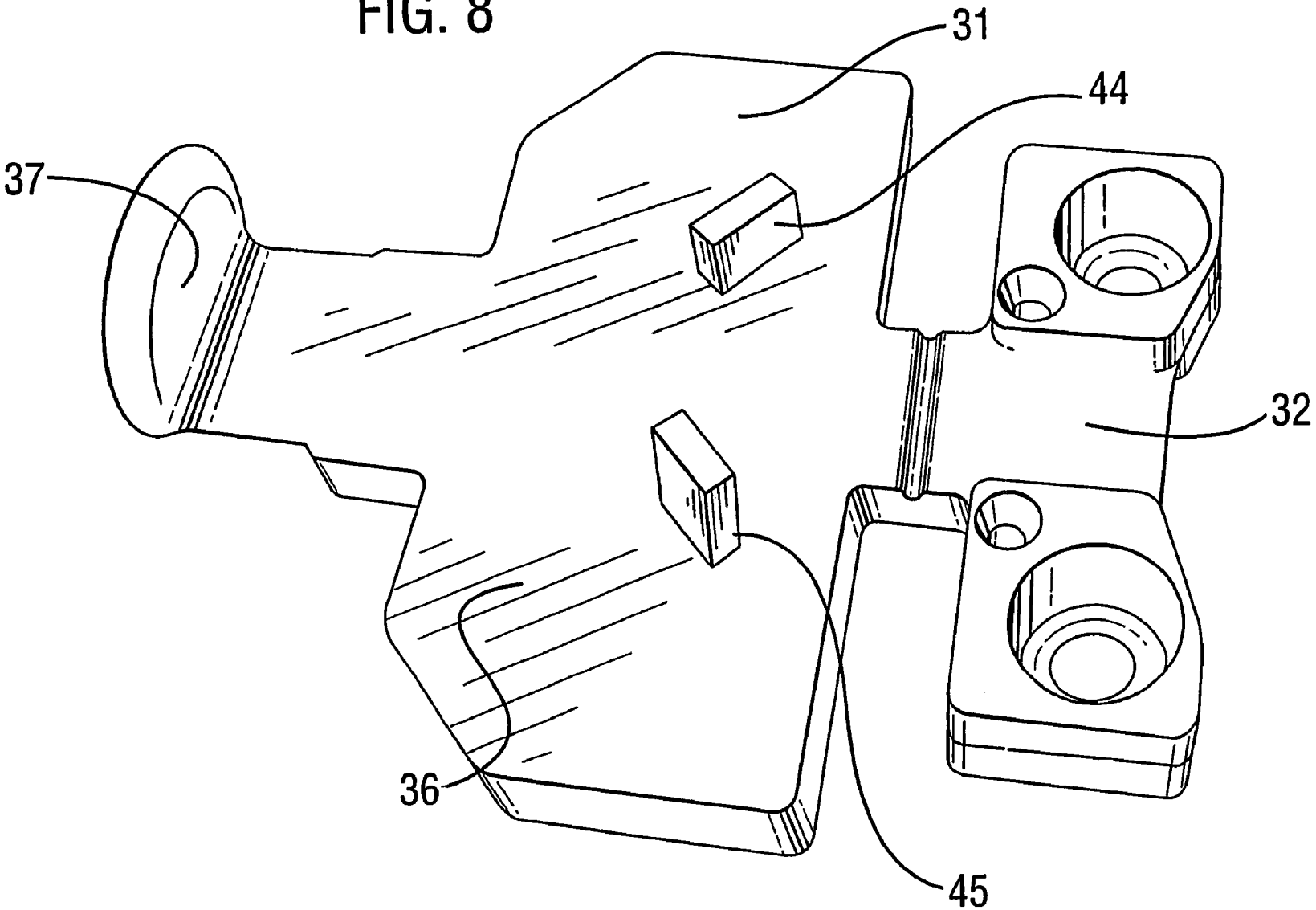

FIG. 8 is an enlarged view of a blanking plate incorporated in the connector shown in FIG. 7.

FIG. 9 shows an enlarged view of a top portion of the handle shown in FIG. 5.

FIG. 10 shows the position of a blanking plate in the top portion of the handle shown in FIG. 9.

Figure 1:
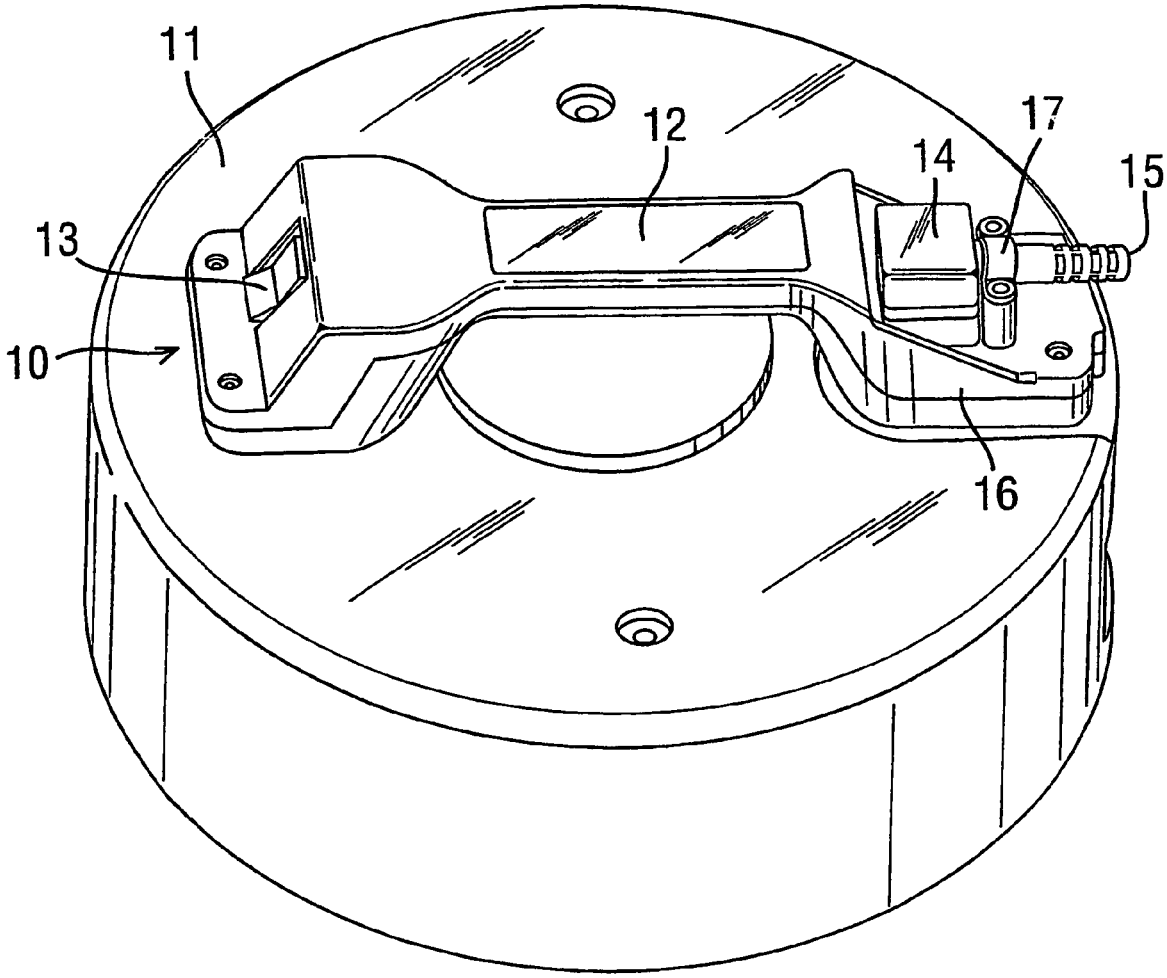
FIG. 1 is a perspective view from one side of a rotary floor polisher according to the present invention.

In FIG. 1 a rotary floor polishing machine is shown generally as 10. The machine comprises a generally flat cylindrical housing 11 in which is accommodated a drive motor and polishing wheel (not shown). Attached to a top portion of the housing is a handle 12. The handle has a leading end 13 which incorporates an on/off switch. The handle has a trailing end 16 in which is incorporated an electrical connector for the polisher.

The electrical connector includes a cable head 14 which is formed with a trailing end 15. In use the trailing end 15 receives a cable which is connected to an electrical power supply, typically mains power supply. The connector is provided with a straddling clamp 17 which is held in place by two self-taping screws (not shown) at respective ends of the clamp.

Figure 2:
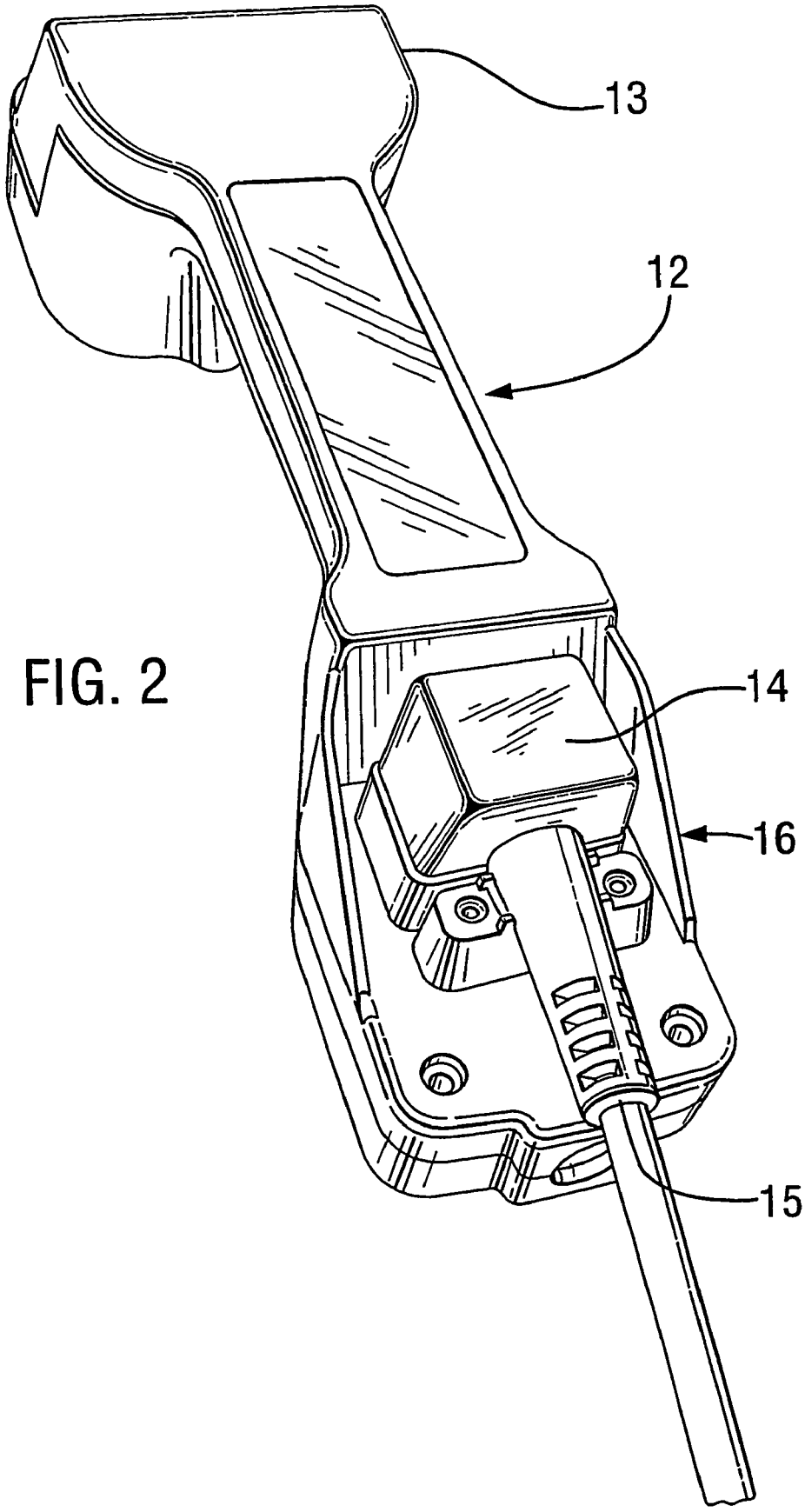
FIG. 2 is a perspective view of a handle portion of the floor polisher.
Figure 3:
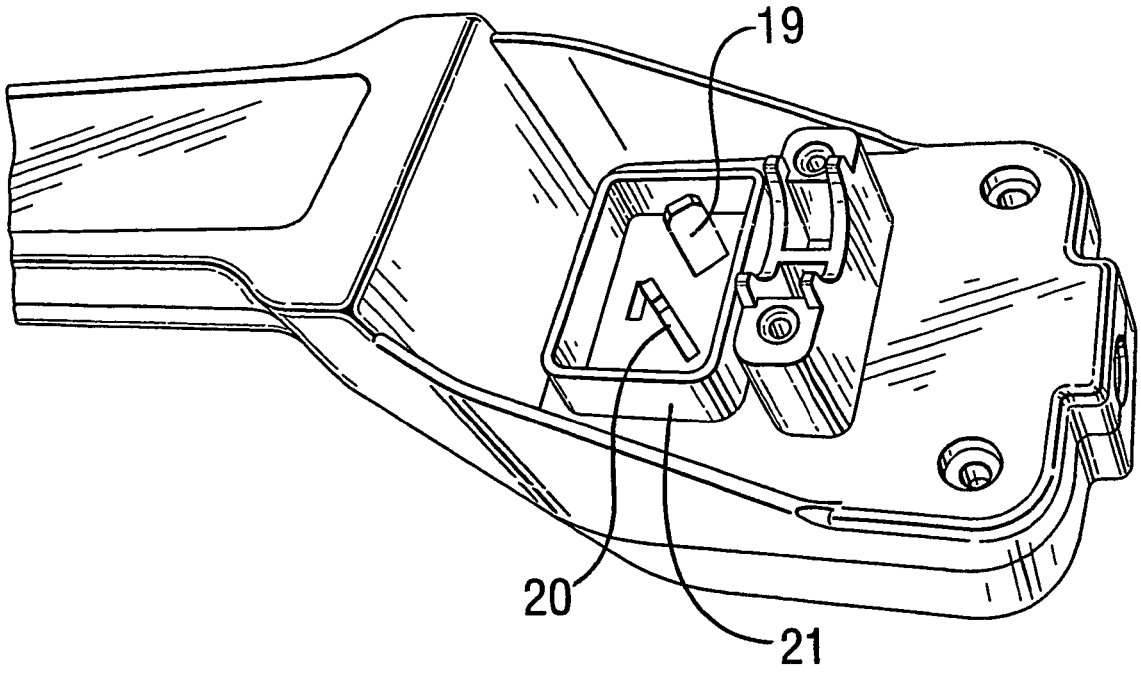
FIG. 3 is an enlarged view of a plug connector incorporated into the handle portion.

In FIG. 2 the handle is shown detached from the body of the cylindrical polisher. FIG. 3 shows an enlarged view of the trailing end 16 of the handle.

In this view the electrical connector has been detached so that a releasable connector is exposed. The releasable connector includes two upstanding angled terminal pins 19 and 20. These are located inside a generally rectangular upstanding locating collar 21.

Figure 4:
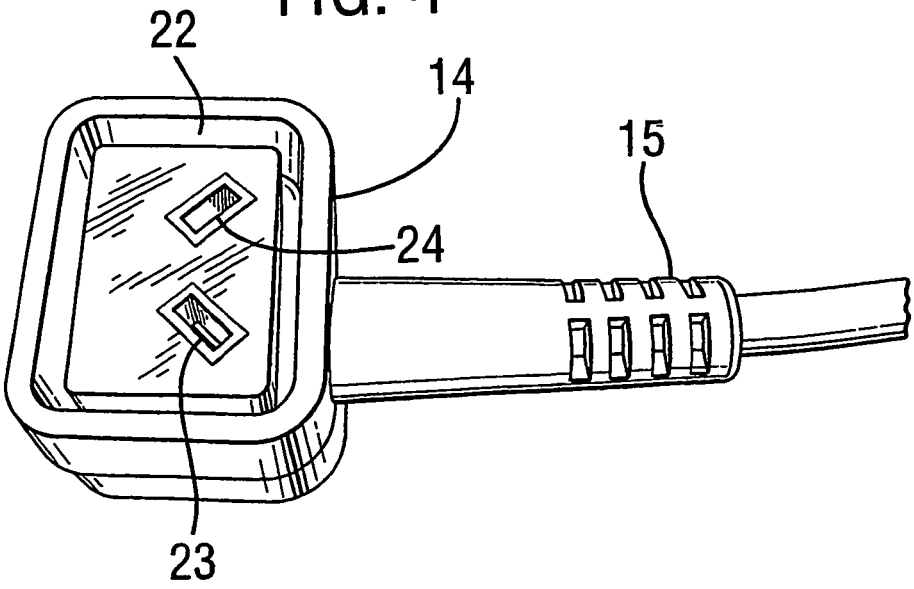
FIG. 4 is a perspective view of an underside of a socket portion attached to a cable connector.

The configuration of the underside of the socket head of the cable connector is shown in FIG. 4. The socket head includes a generally rectangular recess which provides a female engagement with the collar 21 shown in FIG. 3. A surface 23 of the socket head is formed with two angled recesses which receive the upstanding pins 19 and 20. At the base of these recesses are spring-loaded terminal connections (not shown) which are electrically connected to cable cores from the cable connector.

FIG. 5 shows the handle 12 in disassembled form. The handle comprise a base portion 12*a* and an upper portion 12*b*. A trailing end 16*a* of the base portion is provided with two terminals 27 and 28. When attached to the polishing appliance, these terminals provide an electrical connection to the drive unit and associated transformer (not shown). The terminals 27 and 28 each comprise L-shaped terminal pins 19 and 20, respectively, which each define a screw-threaded copper bore (as at 29 in FIG. 5*a*). Each bore 29 receives a clamping screw 41. These terminal pins 19 and 20 protrude through the upper portion of the handle 12*b* to provide a male connection shown in FIG. 3.

A trailing end region of the handle 12*a* and 12*b* is formed with a cutaway collar portion 30*a* and 30*b* an interior portion of the handle is occupied by a blanking plate member 31. The plate member is shown in more detail in FIG. 6. The plate member comprises a leading tab 32 formed with two bores 33 and 34 a neck portion 35 connects the tab to a trailing portion of the plate 36. A trailing end region of the plate is formed with a masking disk 37 which occupies the collar 30*a* (and 30*b*) of the handle trailing end. The mask 37 obstructs the hole defined by the collar 30*a*, 30*b* thereby preventing access to the interior of the handle and the electrical connections contained therein. Thus, the only electrical connection that may be used is the plug and upstanding pins 19 and 20 shown in FIG. 3.

FIG. 7 shows the trailing edge portion of the handle base 12*a* with the blanking plate 30, 31 removed from the assembly. This allows a cable connector to be entered into the handle through the collar 30*a*. The pins 19 and 20 may be removed by unscrewing of screws 40 and 41 entered into the terminals. Exposed cable cores may then be entered into the terminals and clamped in place by rescrewing of the screws 41 and 40.

An underside of the blanking member is shown in FIG. 8. The trailing end plate 36 is formed with two upstanding angled pin blanks 44 and 45. These pin blanks are sized and configured so that they may be entered into pin cutouts formed in the upper portion 12*b* of the handle. These are shown in FIG. 9. The blanking member is shown engaged with the upper portion of the handle in FIG. 10. The pin blanks 44 and 45 are entered into the cutouts for 48 and 47. With the blanking member entered into the pin cutouts, access to the interior electrical terminals via the pin cutouts is prevented.

The blanking member is capable of occupying two positions. One shown in FIG. 6 and one shown in FIG. 10. In FIG. 6 the blanking member prevents access via the collar cutout 30*a* and 30*b*. This prevents a hard-wired connection from being formed by access to the interior of the handle. In FIG. 10, the blanking member prevents access to the terminals via the plug/socket cutouts which are involved in use of the releasable cable connector.

The present invention provides an electrical connector for an appliance which is capable of being used in either a hard-wired or conventional releasable configuration. The blanking member provides a safety feature which prevents inadvertent or unwanted connection of more than one cable connector at any time. In addition, if the conventional releasable cable connector fails or needs to be replaced, the owner or user of the appliance has the option of employing an electrician to make a hard-wired connector in the event that a spare conventional connector is not available.

The invention claimed is:

1. An electrical appliance having a releasable cable connector for electrically connecting the appliance to a remote power supply, wherein a first junction means is adapted to provide the releasable electrical connection between the cable connector and the appliance, characterized by the provision of a second junction means adapted to provide a non-releasable, hard-wired electrical connection between an alternative cable connector and the appliance, wherein the first junction means and the second junction means are arranged and configured so that the selection and use of one of said first and second junction means by attachment of one cable connector precludes the simultaneous selection of the other connector.

2. An appliance as claimed in claim 1 wherein the first junction means comprises a plug and socket combination.

3. An appliance as claimed in claim 2 wherein the socket is provided on the releasable cable connector, and terminal pins mateable therewith are provided on the appliance.

4. An appliance as claimed in claim 1 wherein the second junction means comprises at least electrical two terminals, such as a screw terminal or a wire clamp, which provide means to attach bare connector cable wire cores to the second junction means.

5. An appliance as claimed in claim 1 wherein the releasable or alternative cable connector is a two or three core mains cable.

6. An appliance as claimed in claim 2 wherein plug pins of the first junction means are removably mounted, and removal of the pins prevents use of the releasable connection.

7. An appliance as claimed in claim 6 wherein the plug pins are each electrically connected to respective terminals of the appliance.

8. An appliance as claimed in claim 6 wherein the plug pins are rendered removable by screw-threaded attachment of the pins to appliance electrical terminals.

9. An appliance as claimed in claim 7 wherein the same terminals serve both the first junction means and the second junction means.

10. An appliance as claimed in claim 1 wherein a removable blanking member is provided, which member is mountable on the appliance in two positions; a first position in which the first junction means is obstructed so as to be un-usable for connection to a cable, and a second position in which the first junction means is freed from obstruction and the second junction means is obstructed.

11. An appliance as claimed in claim 10 wherein the blanking member is a plate member.

12. An appliance as claimed in claim 10 wherein the blanking member is formed with one or more dummy plugs or pins which may be entered into a socket or pin-retaining recesses of the first junction means, there by to obstruct connection.

13. An appliance as claimed in claim 10 wherein the blanking member is provided with a masking piece which, in the second position, occupies an opening in the appliance for the alternative cable connection means, thereby obstructing the second junction means against connection.

14. An appliance as claimed in claim 10 wherein in the second position, the blanking member overlays a retaining clamp for the alternative cable, whereby the alternative cable may not be clamped in place while the blanking member is in the second position.

15. An appliance as claimed in claim 10 wherein in the first position, the blanking member overlays socket or pin location features, so that the first junction means may not be used to make a connection.

* * * * *